US007033259B1

(12) United States Patent
Seasholtz et al.

(10) Patent No.: US 7,033,259 B1
(45) Date of Patent: Apr. 25, 2006

(54) HAND SANDER VACUUM ATTACHMENT

(75) Inventors: Craig A. Seasholtz, Avis, PA (US); Randy L. Buss, Muncy, PA (US); Matthew S. Kepner, Watsontown, PA (US)

(73) Assignee: Shop Vac Corporation, Williamsport, PA (US)

( * ) Notice: Subject to any disclaimer, the term of this patent is extended or adjusted under 35 U.S.C. 154(b) by 0 days.

(21) Appl. No.: 11/104,726

(22) Filed: Apr. 13, 2005

(51) Int. Cl.
*B24B 15/04* (2006.01)
*B24B 55/10* (2006.01)

(52) U.S. Cl. ..... 451/354; 451/524; 451/456

(58) Field of Classification Search ..... 451/354, 451/356, 523, 524, 525, 456
See application file for complete search history.

(56) References Cited

U.S. PATENT DOCUMENTS

| | | | | |
|---|---|---|---|---|
| 310,013 | A | | 12/1884 | Ambler |
| 1,501,192 | A | | 7/1924 | Severns |
| 1,544,368 | A | | 6/1925 | Brennan |
| 2,499,933 | A | | 3/1950 | Smul |
| 2,711,059 | A | | 6/1955 | Ames |
| 2,722,789 | A | | 11/1955 | Robins |
| 2,904,939 | A | | 9/1959 | Raia |
| 2,929,177 | A | * | 3/1960 | Sheps ..... 451/456 |
| 3,224,149 | A | | 12/1965 | Harrington et al. |
| 3,395,415 | A | | 8/1968 | Leland |
| 3,638,362 | A | | 2/1972 | Stoll |
| 3,826,045 | A | | 7/1974 | Champayne |
| 3,932,966 | A | | 1/1976 | Stern |
| 3,967,417 | A | | 7/1976 | Jurak |
| 4,062,152 | A | | 12/1977 | Mehrer |
| 4,158,935 | A | | 6/1979 | Robert |
| 4,296,572 | A | | 10/1981 | Quintana |
| 4,320,601 | A | | 3/1982 | Haney |
| 4,368,598 | A | | 1/1983 | Kuhlmann |
| 4,549,371 | A | | 10/1985 | Hakoda |
| 4,598,500 | A | | 7/1986 | Faraudo et al. |
| 4,616,449 | A | | 10/1986 | Marton |
| 4,646,480 | A | | 3/1987 | Williams |
| 4,680,895 | A | | 7/1987 | Roestenberg |
| 4,697,389 | A | | 10/1987 | Romine |
| 4,759,155 | A | | 7/1988 | Shaw |
| 4,779,385 | A | | 10/1988 | Reiter |
| 4,782,632 | A | | 11/1988 | Matechuk |

(Continued)

FOREIGN PATENT DOCUMENTS

| | | |
|---|---|---|
| DE | 2720622 | 11/1978 |

(Continued)

OTHER PUBLICATIONS

Pages from internet cite www.lovelessash.com/Sander/Sander1.html entitled Drywall Sander, "The Turbo Drywall Sander". Mar. 14, 2003.

*Primary Examiner*—Robert A. Rose
(74) *Attorney, Agent, or Firm*—Marshall, Gerstein & Borun LLP

(57) ABSTRACT

A manual sander vacuum attachment, providing edge sanding and multiple positioning capabilities, having a lower sanding backer plate member, which carries a soft sanding pad and secures the sandpaper sheet, and an upper housing portion, having a generally horizontal platform with two vertically-extending stanchion supporting a handle therebetween, with a vacuum fitting for connection to a hose for a vacuum air source, and a peripheral skirt surrounding the backer plate member, whereby all vacuum air flow of sanded debris travels about periphery of sander backing plate up into interior of the housing portion.

37 Claims, 8 Drawing Sheets

U.S. PATENT DOCUMENTS

| | | | |
|---|---|---|---|
| 4,839,995 | A | 6/1989 | Hutchins |
| 4,937,984 | A | 7/1990 | Taranto |
| D310,013 | S | 8/1990 | Watson |
| 4,964,243 | A | 10/1990 | Reiter |
| 4,965,966 | A | 10/1990 | Braasch |
| 5,007,206 | A | 4/1991 | Paterson |
| 5,036,627 | A | 8/1991 | Walters |
| 5,193,313 | A | 3/1993 | Sanchez et al. |
| 5,239,783 | A | 8/1993 | Matechuk |
| 5,245,797 | A | 9/1993 | Milkie |
| D344,003 | S | 2/1994 | Milkie |
| 5,283,988 | A | 2/1994 | Brown |
| D353,313 | S | 12/1994 | Stiles |
| D354,666 | S | 1/1995 | Kriebel |
| 5,540,616 | A | 7/1996 | Thayer |
| 5,609,516 | A | 3/1997 | Courson et al. |
| 5,695,389 | A | 12/1997 | Bartel et al. |
| D392,860 | S | 3/1998 | Brown |
| 5,791,979 | A | 8/1998 | Duncan et al. |
| 6,053,805 | A | 4/2000 | Sanchez |
| 6,347,985 | B1 | 2/2002 | Loveless |
| 6,616,518 | B1 | 9/2003 | Sun et al. |
| 6,634,843 | B1 | 10/2003 | Tarnow et al. |
| 6,746,321 | B1 | 6/2004 | Link |
| 2001/0051501 | A1 | 12/2001 | Pellegrin |
| 2002/0025767 | A1 | 2/2002 | Chen |

FOREIGN PATENT DOCUMENTS

| | | |
|---|---|---|
| DE | 3413028 | 10/1985 |

* cited by examiner

HAND SANDER VACUUM ATTACHMENT

FIELD OF THE DISCLOSURE

This disclosure relates to a hand-operated sanding tool for attachment to a vacuum source, and more particularly to such an apparatus having edge-sanding and multiple positioning capabilities.

BACKGROUND OF THE DISCLOSURE

There have been numerous attempts to provide hand sanding tools, blocks and other apparatus that will connect, via a vacuum hose, to a vacuum source. Many of such known sanding tools have no capability of adjustment, such that the sanding tool cannot be used for close-in edge-sanding purposes. Further, for many of the prior known vacuum-type sanding tools, the airflow created by the vacuum goes directly through the sanding pad or directly through the sandpaper, or both, thereby mandating the use of an open, flow-through type of sanding screen. This greatly limits the user's options as to availability of sanding medium. Furthermore, these types of screens may be subject to plugging due to build up of debris or other variables. This potential plugging could result in a performance loss.

SUMMARY OF THE DISCLOSURE

Thus, in one aspect of the present disclosure, there is a manual sander apparatus having a lower sanding backer plate with front end and rear end fastener means for holding configured spring metal clamp members in place against the backside of that backer plate. These clamps hold down and maintain taughtness of the respective tail ends of the underlying sandpaper sheet. There is also a configured, generally hollow upper body portion, which mates with the backer plate, and which has a surrounding skirt section with front and rear lower skirt extensions. The body portion is held in place against the sanding backer plate by a threaded fastener. A slotted opening formed in an interior platform area on the upper handle body portion, in conjunction with a threaded fastener holding that upper body portion to the lower sanding backer plate, permits either centered positioning, or relative side-to-side adjusted positioning, of the sanding plate vis-à-vis the upper handle body portion. This, in turn, permits the sanding backer plate and associated sandpaper sheet to be either centrally aligned, or as desired, to be positioned completely over to either one or the other edge surface of the upper body portion, to thereby achieve edge sanding. Further, all vacuum airflow, which contains the sanded-off sawdust, drywall dust, or like powdered debris, is around the periphery of the sandpaper sheet and sanding backer plate. That vacuum airflow is also directed, via associated ribs and controlled reliefs, along airflow channels that are formed on the underside of the upper body portion, e.g. to and along the front and rear edges of the backer plate, which airflow then eventually flows out through the vacuum pipe fitting formed at the rear of the hand sander vacuum unit.

BRIEF DESCRIPTION OF THE DRAWINGS

The foregoing and other aspects of the present disclosure are illustrated in the following drawings, in which.

DETAILED DESCRIPTION OF THE DISCLOSURE

Figure 1:
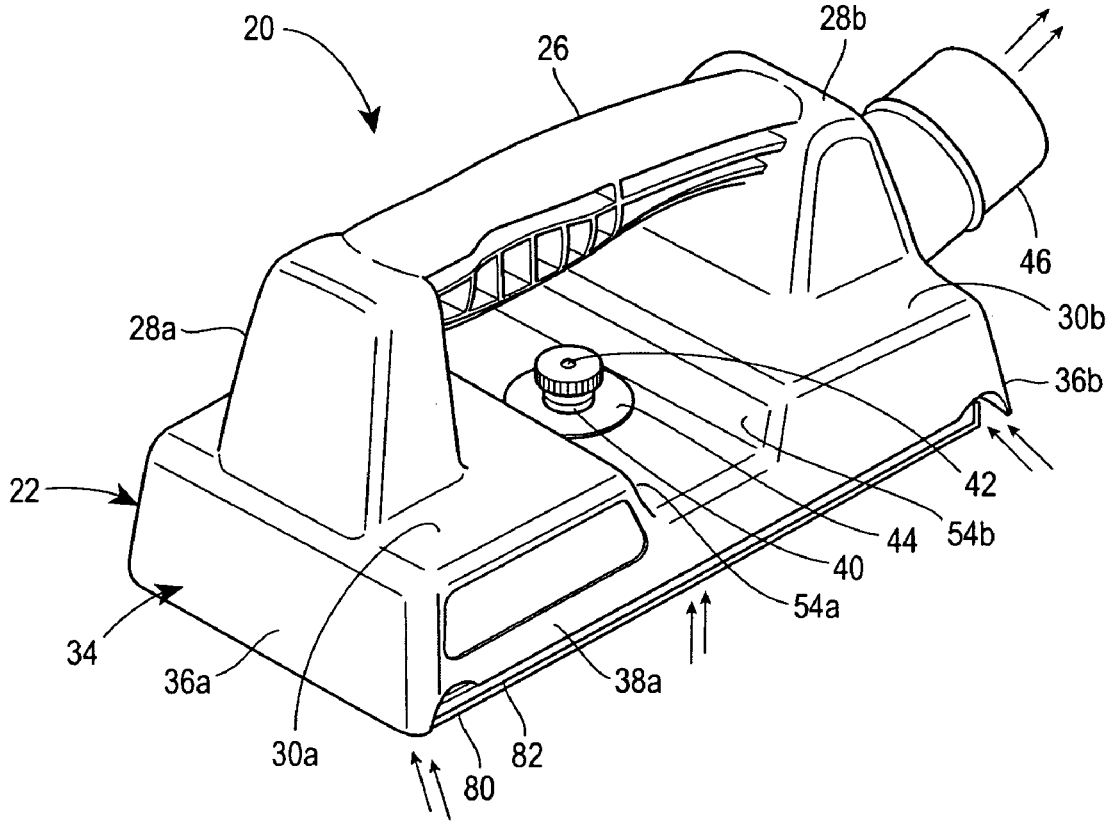
FIG. 1 is a front prospective view of the vacuum sander tool of the present disclosure.
Figure 2:
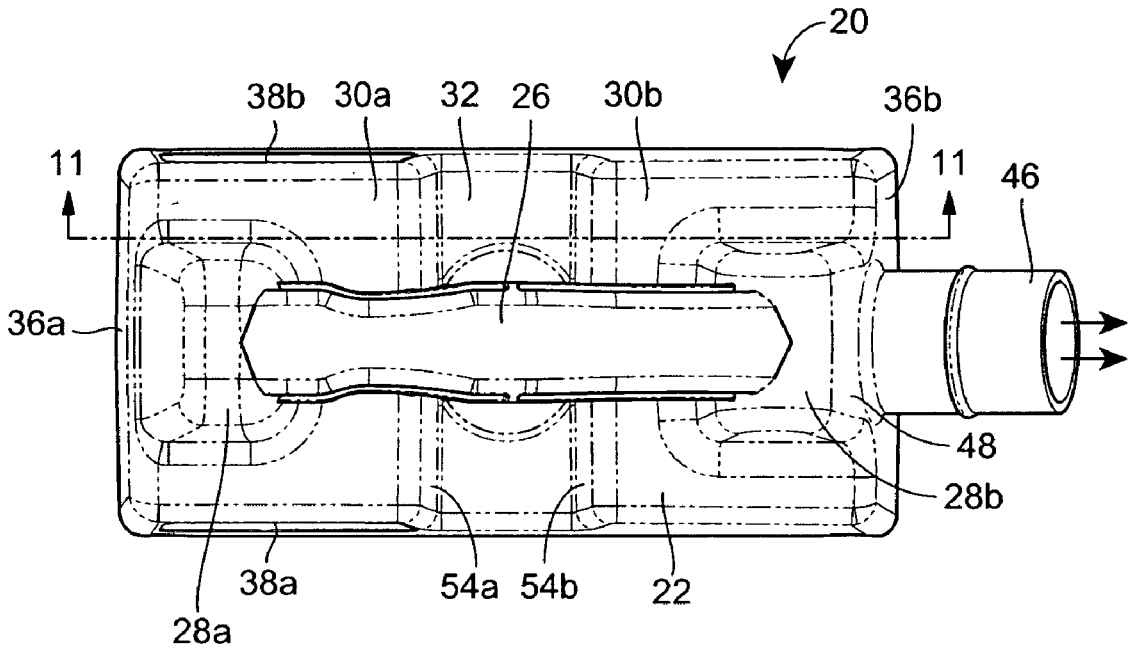
FIG. 2 is a top plan view of the vacuum sander tool of FIG. 1.
Figure 3:
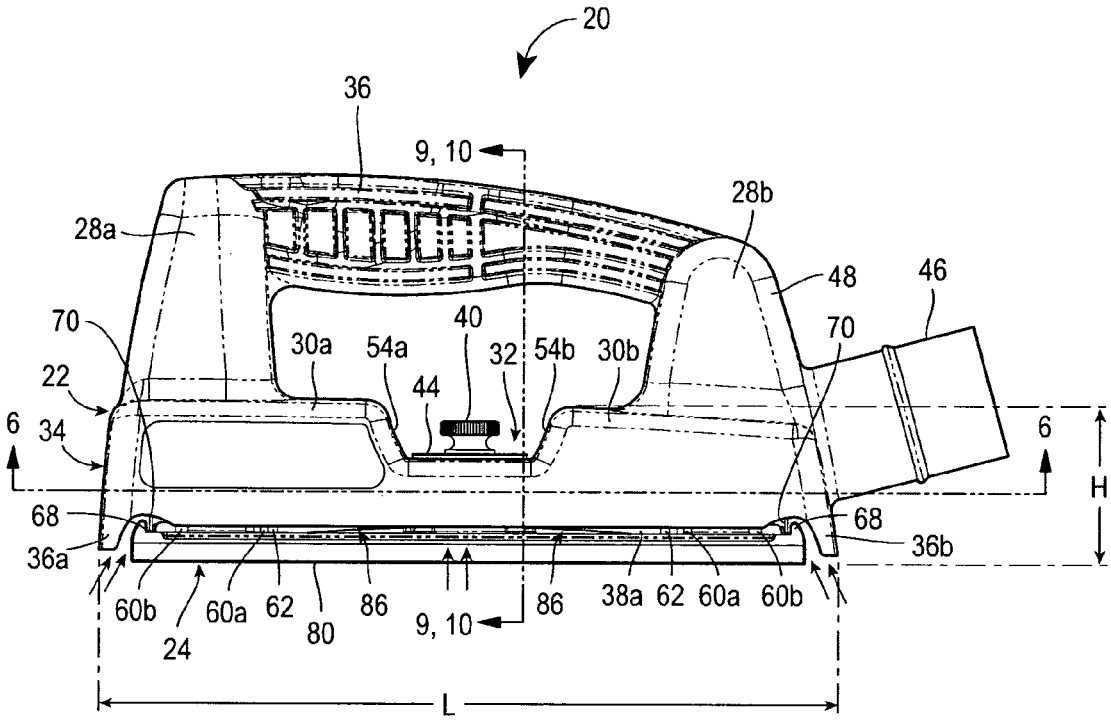
FIG. 3 is a side elevation of the vacuum sander tool of FIG. 1.
Figure 4:
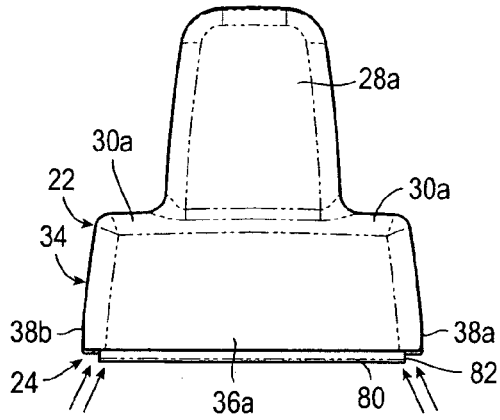
FIG. 4 is a front elevation of the vacuum sander tool of FIG. 1.

With reference to the drawings, in which like reference numerals indicate like elements, there is shown in FIG. 1 the hand sander vacuum attachment assembly of the present disclosure, generally denoted by reference numeral 20. Assembly 20 is preferably formed primarily of injection-molded plastic components, comprising an upper body housing portion 22 and a lower sanding backer plate portion 24, which when assembled together create the overall vacuum sander assembly 20. The housing portion 22 includes a handle segment 26 formed and supported between two upstanding generally hollow support stanchions 28*a*, 28*b*, the latter being respectively formed integral with front and rear platform sections 30*a*, 30*b*, which in turn are separated by a central trough portion 32. Further, the handle 26 is preferably formed as a solid component, such that there is no vacuum air flow through the same, which thereby assists in helping maintain the substantial majority of the vacuum air flow under the front and rear platform sections 30*a*, 30*b* and thus, about the periphery of the backer plate 24. As best seen in FIGS. 1 and 3, a surrounding skirt member 34 extends downwardly from the front and rear platform sections 30*a*, 30*b* and from central trough 32. Thus, skirt member 34 extends around the entire perimeter of the upper housing portion 22 and generally about the backer plate 24. It will be noted that the respective front and rear skirt sections 36*a*, 36*b* purposely extend further down than do the side skirt sections 38*a*, 38*b*, such that the entire edge of the backer plate 24 is exposed on both sides along its length adjacent side skirt sections 38*a*, 38*b*.

Preferably, the housing portion 22 is formed of copolymer polypropylene while the backer plate 24 is formed of ABS plastic. It will be understood that yet other materials can be used to form these components, bearing in mind the desire to have the backer plate 24 remain as flat as possible.

Figure 6:
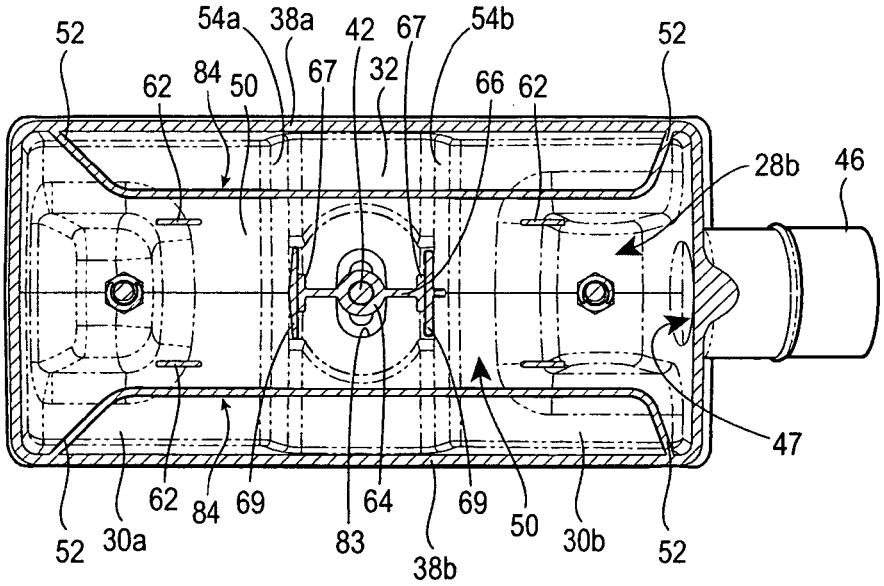
FIG. 6 is a bottom section view, taken along lines 6—6 of FIG. 3.

The backer plate portion 24 is held in place against the underneath side of the upper housing 22 by way of a threaded fastener 40, shown in FIGS. 1 and 3 as a thumb nut, which is fastened to a threaded fastener, shown in FIGS. 3 and 6 in the form of a headed bolt 42 with associated washer 44.

A rearwardly-extending pipe-like fitting 46 is integrally formed with the housing portion 22; preferably, fitting 46 extends from the rear stanchion 28*b* and rear platform section 30*b*. The pipe-like fitting 46 can be connected to the vacuum intake hose of a suitable vacuum source (neither shown), such that vacuum air flows in the direction of the double arrows (see, for example, FIGS. 1–4). It is to be understood that, while the fitting 46 can be assembled anywhere along, for example, the front or rear stanchions 28*a*, 26*b*, it is preferably integrally formed at a substantially lower position. i.e. along the lower portion of the rear wall 48 of rear support stanchion 28*b* and of rear platform section 30*b*. In that position, fitting 46 is able to create the best direct flow of needed vacuum air between the interior space (generally denoted by reference numeral 50) of the housing 22 and the hose (not shown) for the vacuum air source.

As best seen in FIGS. 5, 6, and 8–11, portions of the generally hollow interior 50 of housing 22 are shown. That is, housing 22 includes angled support members 52 (which are part of air flow control ribs 84), and respective front and rear cross walls 54*a*, 54*b* (which form a portion of the central trough 32).

Figure 7A:
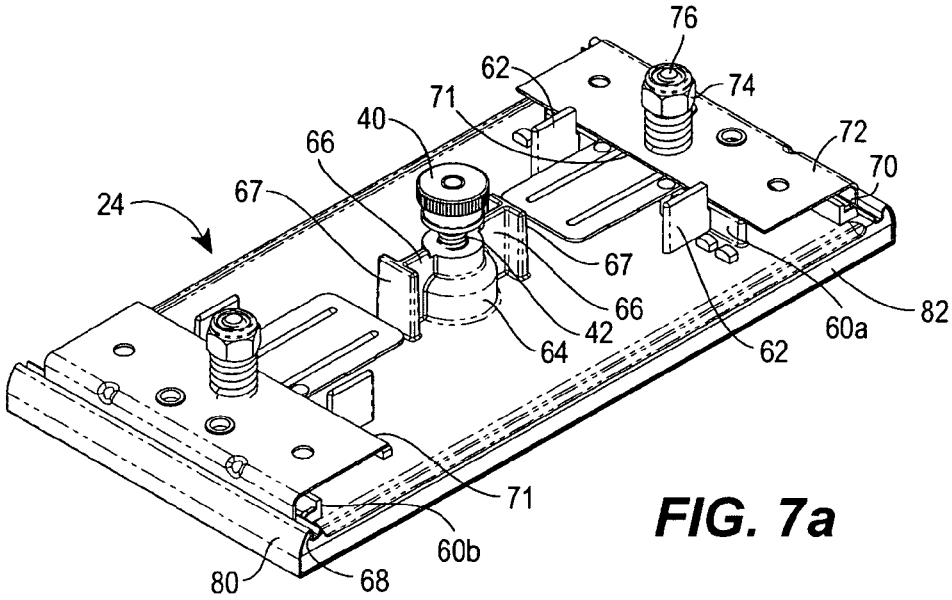
FIG. 7*a* is a perspective view of the sanding backer plate, clamp and attached sandpaper.
Figure 7B:
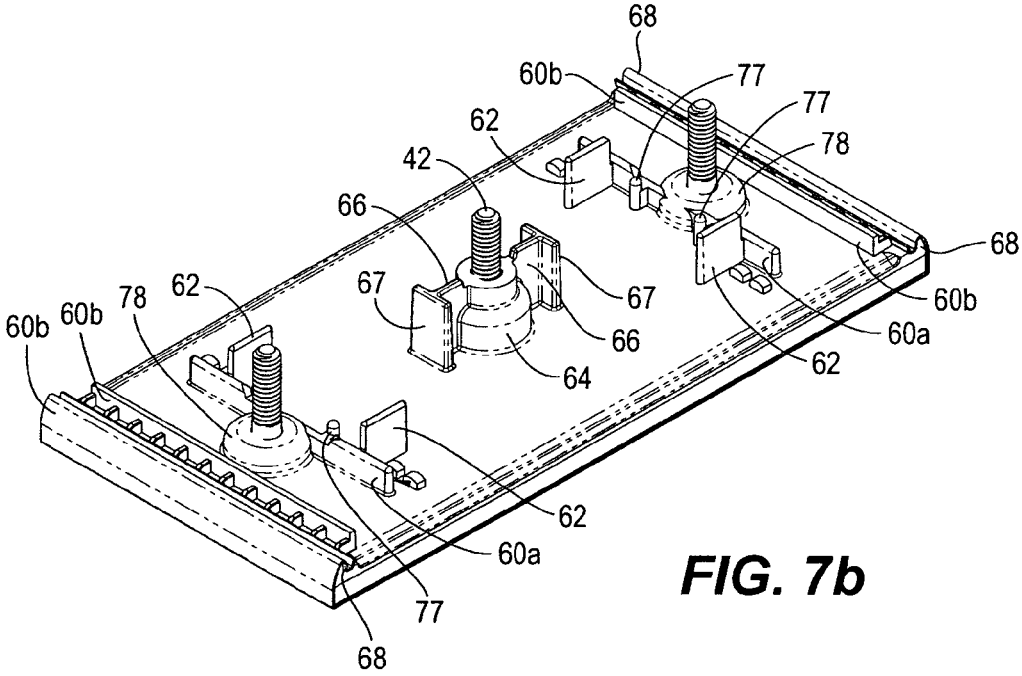
FIG. 7*b* is a perspective view similar to FIG. 7*a*, but with the clamp and sandpaper removed for better viewing.

Turning to FIGS. 7*a* and 7*b*, there is shown the lower sanding backer plate portion 24, as having transverse front and rear clamp support walls 60*a*, 60*b*, and longitudinally aligned backer plate stops 62. Centrally formed in the top surface of backer plate 24 is an upstanding support boss 64 which retains a headed threaded fastener 42, such as a bolt (see FIG. 6). Vertical support ribs 66, formed adjacent support boss 64, are present to support the underneath surface of the central trough portion 32. The respective support ribs 66 each terminate in a cross support wall 67, to aid in the repositioning process of backer plate 24, as explained later herein.

As seen in FIGS. 3 and 7*a*, 7*b*, the sanding backer plate 24 includes, at each of its respective ends, an upstanding stop ledge 68, which helps create an L-shaped corner. The bent tail ends 70 of the respective metal clamp plates 72 seat within the L-shaped corner formed by the respective stop ledges 68. A quick release clamp device 65 includes the clamp plates 72 that are held tightly in place by both respective coil springs 73 and locking threaded fasteners 74, e.g. locking hex nuts, as fastened to the threaded members 76, which are carried by support bosses 78 (see FIG. 7*b*) formed on the upper side of the backer plate 24. The clamp plates 72 are respectively supported and held in proper alignment by the clamp support walls 60*a*, 60*b*, and fasteners 74, 76, whereby the respective ends of a sheet of sandpaper 80 are clamped and held in place within the L-shaped corner of stop ledges 68 by the clamp tail ends 70. More specifically, the locking fasteners 74 act to contain and preload the coil spring 73, which in turn provides a downward force on the clamp plates 72 to secure the sandpaper. The clamp lever 75 is operatively positioned just below the clamp plate 72 and pivots about two support posts 77 (see FIG. 7*b*) upstanding from the backer plate 24. By pushing down on the free outer ledge of the clamp lever 75, that lever pivots about the support posts 77 and acts to lift up the clamp plate 72 from its normal spring-biased operating position, while at the same time compressing the coil spring 73. The force, and thus overall feel, of the clamping action of clamp levers 75 and clamp plates 72 can be altered by tightening or loosening the locking fastener 74. Preferably, the clamp plates 72 and clamp levers 75 are formed of a stamped, stainless steel material. It will be understood, however, that instead of using the quick release clamp device 65, the coil springs 73 and the clamp levers 75 could be eliminated, and instead, basic thumb nuts (not shown) could be used to manually tighten and hold down (via threaded members 76) the clamp plates 72 against the sandpaper sheet 80.

A soft sandpaper pad 82, such as preferably formed of a suitable foam or rubber material, is attached to the underneath side of the backer plate 24; pad 82 acts to forgive the disparity between the flatness of the sanding plate 24 and the associated surface (not shown) being sanded. The clamp tail ends 70, coupled with the fact that the back edges 71 of clamp plates 72 bear against backer plate 62, cooperate and limit the tendency for the ends of sandpaper sheet 80, as well as clamp plates 72, to skate forward against the stop ledges 68, and thus, act to help prevent any loosening of the tightness of the sandpaper 80 as stretched across the underlying pad 82.

Figure 13:
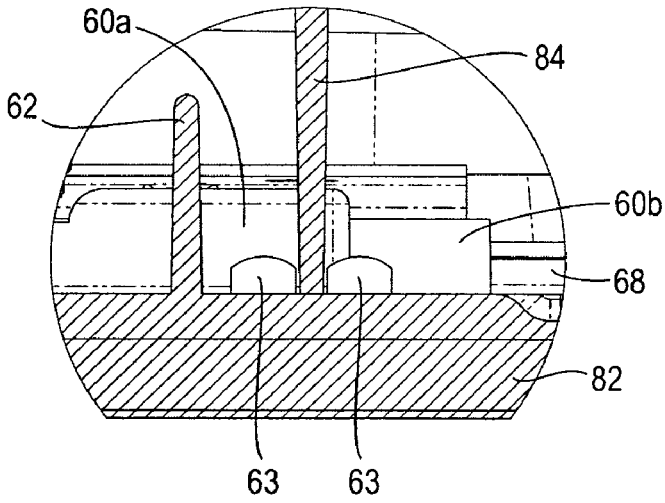
FIG. 13 is an enlarged view of a lower right side portion of FIG. 9, corresponding to the area identified by the broken line referenced as "13" in FIG. 9.

As further seen in FIGS. 7*a*, 7*b* and 13, there are respective pairs of repositioning ribs 63. That is, ribs 63 aid in the desired repositioning of the backer plate 24 relative to the housing 22, so as to permit center- or either side-edge sanding, as desired. More specifically, the plurality of pairs of repositioning ribs 63, as formed outwardly at the front and rear of the topside of the backer plate 24, cooperate with lower edge portions of the air flow control ribs 84 (described below), and together act to minimize the potential for the backer plate 24 from skewing relative to the housing 22.

FIG. 6 shows a bottom section view of the upper body portion 22. As seen, there are a pair of air flow control ribs 84 present between the respective side skirt members 38*a*, 38*b*, and including the angled support members 52. These air flow control ribs 84 create a central vacuum air channel along the interior 50 of assembly 20 and help direct maximum vacuum air towards the front end of the assembly 20 during the vacuum sanding operation. Further, in FIG. 11, there are seen certain so-called controlled air relief cutaway areas 86, as formed between the ribs 84 and the upper surface of the sanding backer plate 24. Those controlled air relief areas 86, in combination with the air flow control ribs 84, help to equalize and provide a uniform and efficient vacuum air flow pattern within the elongate central portion of the interior 50 of assembly 20, as well as around the periphery of the sanding backer plate 24. More specifically, the presence and relative height of the controlled air relief areas 86 in ribs 84 permits the proper needed amount, i.e. equalized amount, of incoming airflow along the sides of apparatus 20 via the relief areas 86 to merge into the main air flow going down the central area of the interior of interior 50 between air central ribs 84. That is, if the controlled air relief areas were too large or wide open, the influx of side air would be too strong and thereby rob performance from the front end of apparatus 20. Likewise, if the controlled air reliefs 86 were too small or non-existent, the air influx from the front would be too strong, and the side air influx would be too ineffective. Hence, collectively, the ribs 84 and relief areas 86 help equalize the air flow and help maximize collection of sanded-off dust debris.

In FIG. 6 is also shown how the respective cross support walls 67 (formed atop backer plate 24 at each end of vertical support ribs 66) operate to bear against the respective guide ribs 69 carried by the upper housing 22. In operation, the cross support walls (of backer plate 24) cooperate with the guide ribs 69 (of housing 22) to help limit the potential for skewing, i.e. of the backer plate 24 relative to the housing 22, when the backer plate 24 is temporarily disengaged from its desired useable position vis-à-vis the housing 22.

Further, because the two vertical support stanchions 28*a*, 28*b* are of relatively narrow width and depth, i.e. of minimal cross-sectional dimension, they do not overly interfere with vacuum air flow within interior 50 of housing 22. That is, they allow substantially low lying platform surface areas to be present in the form of front and rear platform sections 30*a*, 30*b*. This, in turn, helps the pattern of vacuum air (as primarily working between air flow control ribs 84 within the interior 50 of housing 22) to best reach the front end of assembly 20, in a simple and free manner. It will be noted that the ribs 84 respectively flare out, via angled support members 52, to allow sanding debris to enter under respective front and rear skirt extensions 36*a*, 36*b*. It will be further noted that the enlarged vacuum air area (created via angled support member 52) at the front of the backer plate is preferably greater than the enlarged vacuum air area (created via members 52) at the rear of the backer plate, to thereby assist in maximizing movement of vacuum air to the front of the housing member.

Figure 5:
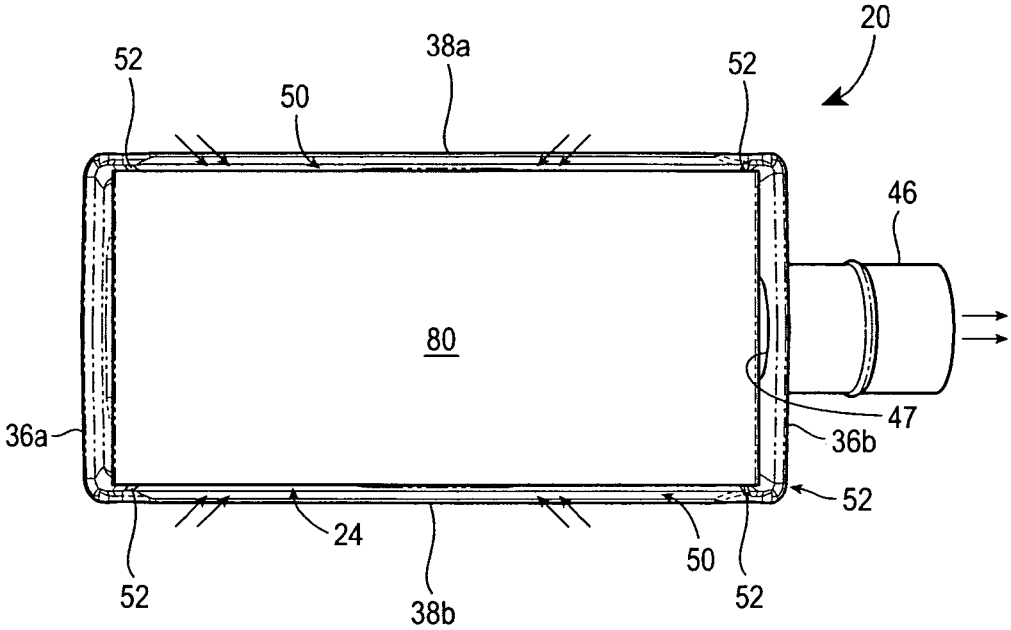
FIG. 5 is a bottom plan view of the vacuum sander tool of FIG. 1.
Figure 8:
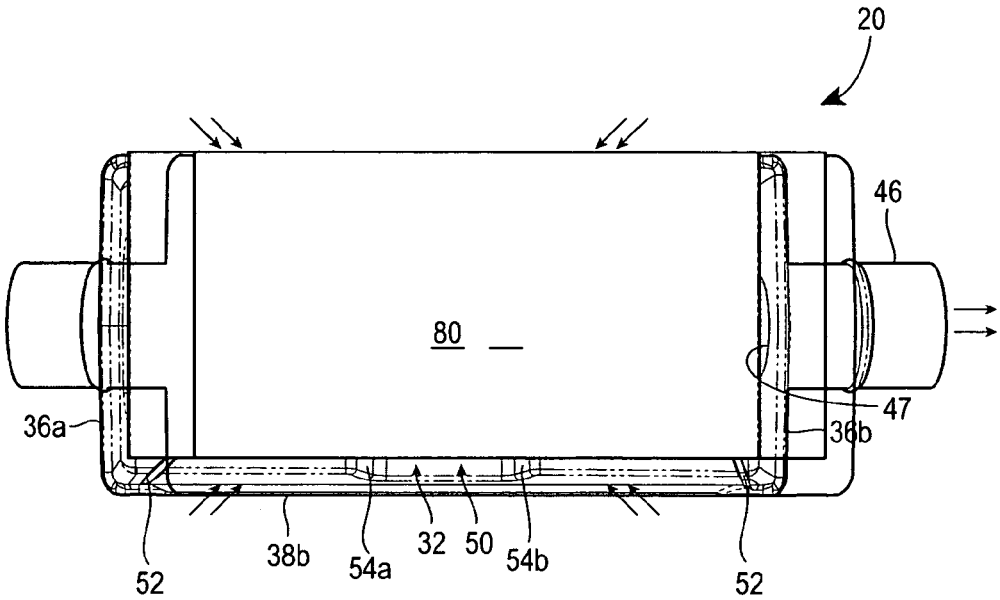
FIG. 8 is another bottom plan view, similar to FIG. 5, but instead of being centered, with the lower sanding backer plate and sandpaper adjusted to a far edge.
Figure 9:
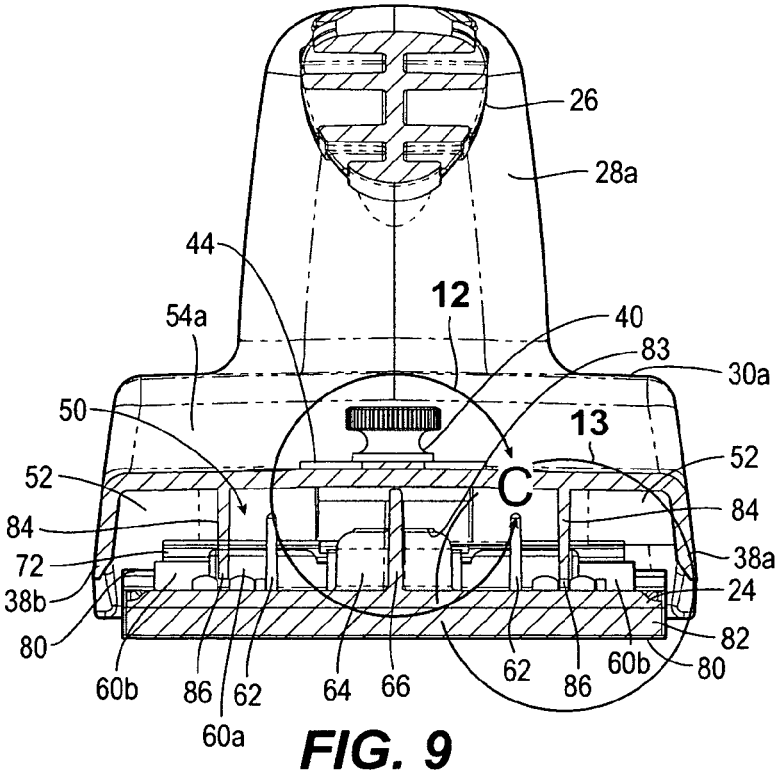
FIG. 9 is a cross section elevational view of the vacuum sander tool of FIG. 3, taken along lines 9—9 thereof.
Figure 10:
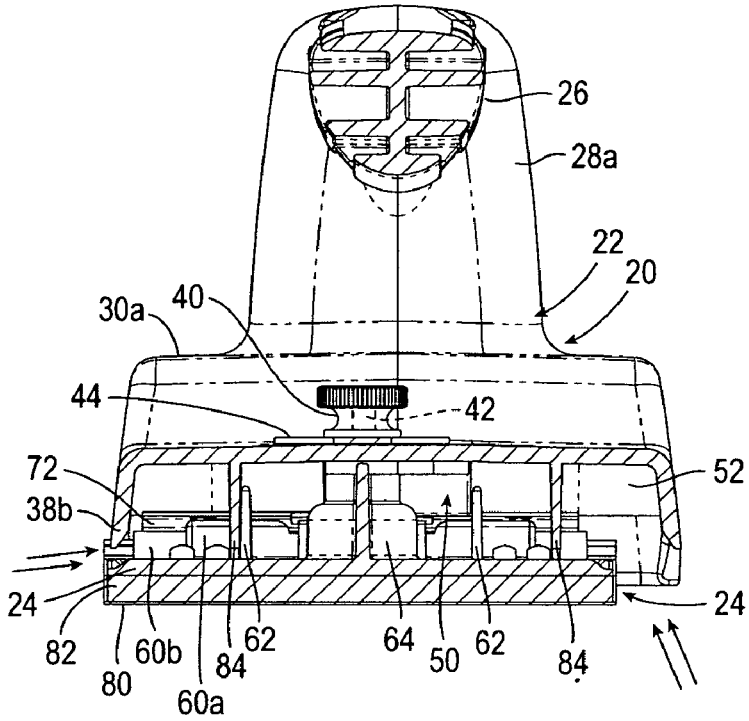
FIG. 10 is a cross section elevational view of the vacuum sander tool of FIG. 3, taken along lines 10—10 thereof, but with the sanding backer plate moved to the far edge, as per FIG. 8.
Figure 11:
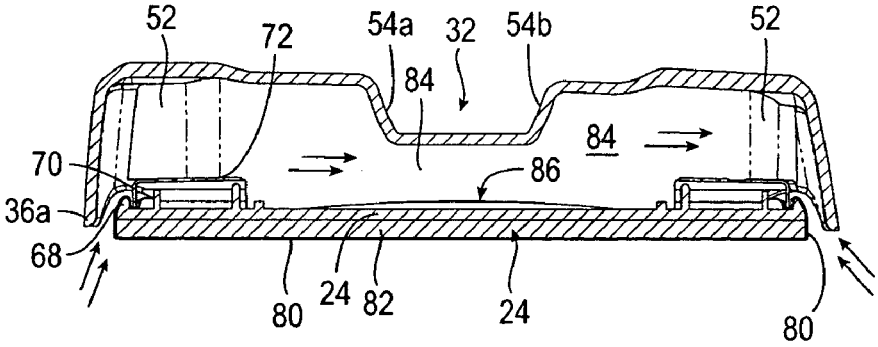
FIG. 11 is a cross-section view of the upper body portion of the vacuum hand sander of FIG. 2, taken along lines 11—11 thereof.
Figure 12:
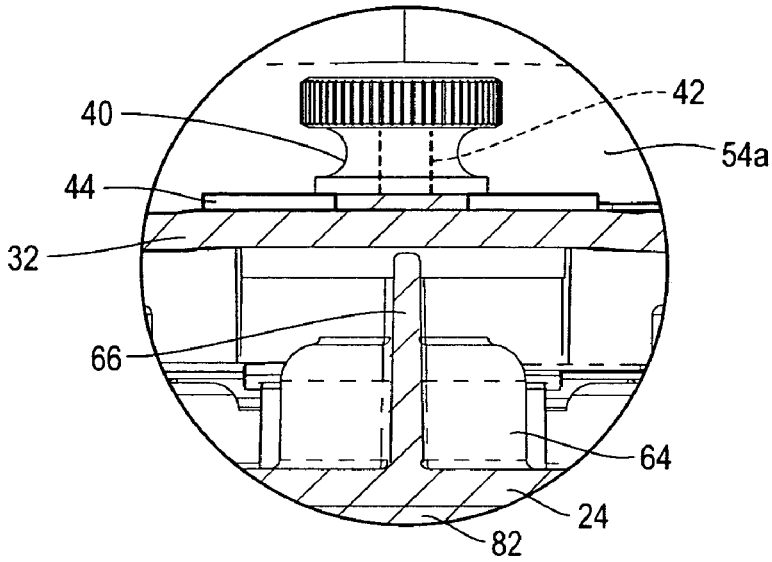
FIG. 12 is an enlarged view of a lower central portion of FIG. 9 corresponding to the area identified by the broken line referenced as "12" in FIG. 9.

Importantly, during operation, the present hand sander vacuum apparatus assembly 20 is capable of a multitude of different transverse positionings of the sanding backer plate 24 to facilitate various types of sanding. For example, as shown in FIGS. 5 and 9, the backer plate 24 and associated sandpaper sheet 80 can be used in a centered arrangement, i.e. where both longitudinal edges of the sandpaper sheet 80 reside inwardly of the side skirt members 38*a*, 38*b*. On the other hand, as seen in FIGS. 8 and 10, the backer plate 24, and hence sandpaper sheet 80, can be adjustably moved (to the respective extreme upper and left positions in those figures) so that the leftmost edge (FIG. 10) of the backer plate 24, sandpaper pad 82, and hence sandpaper sheet 80, are all positioned just slightly outwardly of the outer left edge of the side skirt member 38*b*. In that adjustable position, the sandpaper 80 can be used to facilitate edge sanding of an article to be sanded (not shown). Similarly, although not shown in the drawings, it will be appreciated that the backer plate 24, sandpaper pad 82, and sandpaper sheet 80 can be equally moved to the far respective lower and right side (relative, for example, to FIGS. 5 and 9), so that the right edge (FIG. 9) of the sandpaper sheet 80 can be fully extended out slightly past the right edge of the side skirt member 38*a*, that is, in an adjusted position equal but opposite to those shown in FIGS. 8 and 10. As seen in FIGS. 7*a*, 7*b* and 13, to best achieve such center- or edge-sanding positioning, the lower edge portion of air flow control ribs 84 fits either in between, to one side of, or to the other side of, the respective pairs of repositioning ribs 63, formed on backer plate 24, so as to help assure proper positioning of, and to help aid in penetrating any skewing of, the backer plate relative to the housing 22.

The structure permitting such advantageous side-to-side positioning of the backer plate 24 and sandpaper sheet 80, relative to the housing 22, and positions of the side skirt members 38*a*, 38*b* comprises the relative positioning of the shaft of fastener 42 (held within support boss 64 of backer plate 24) with the slotted opening 83 (formed in central trough surface 32, of housing 22), see FIG. 6. That is, by unloosening threaded fastener 40, on fastener 42, the backer plate assembly 24 can be adjusted side-to-side relative to the housing 22, via adjustable moving fastener 42 within slot 83, and hence, adjusting sanding position of backer plate assembly 24 relative to housing 22, and lower edge of air flow control ribs 84 relative to the respective repositioning ribs 63. More specifically, that side-to-side adjusted positioning of backer plate assembly 24 sometimes causes abutting engagement of the respective backer plate stops 62 (formed on plate 24) vis-à-vis the air flow control ribs 84 (carried by the housing 22). That is, as seen in FIGS. 6 and 9, for example, the respective backer plate stops 62 are generally centered between, and not in engagement with, the right or left control ribs 84. On the other hand, where the position of sandpaper sheet 80 and backer plate 24 has been adjusted to one of the edges (see FIGS. 8 and 10), the leftmost backer plate stop 62 (as seen in FIG. 10) now has been moved to, and abuts against, the control ribs 84. This readily adjustable side-to-side movement of the backer plate 24 and sandpaper sheet 80 is significant in that it permits edge sanding to be accomplished by hand sander vacuum assembly 20, and either along the right-hand or left-hand edges of the hand sander vacuum apparatus 20. Alternatively, as desired, assembly 20 will permit normal centered sanding with the sandpaper sheet 80 at a centered position, see FIGS. 5 and 9.

As seen in FIGS. 1 and 3, for example, the respective front and rear skirt extension portions 36*a*, 36*b* preferably extend further down towards the sandpaper sheet 80 than do the side skirt members 38*a*, 38*b*. The presence of such front and rear skirt extensions 36*a*, 36*b* greatly facilitates minimizing the amount of drywall or other sanded dust debris that is not otherwise collected by the assembly 20. Further, and preferably, the height of the majority of assembly 20 (see dimension "H" in FIG. 3) is no greater than within the range of some 15% to 30% of the overall length of the housing 22 (see dimension "L" between the respective front and rear skirt extensions 36*a*, 36*b*, in FIG. 3). Preferably, that percentage is approximately 21.5%. For example, apparatus 20 made in accordance with the present disclosure, the dimension H was approximately 1.75 inches, while the dimension L was approximately 8.12 inches. That is, the height ("H") of the majority of the housing 22 is sufficiently low enough such that a maximized vacuum air flow reaches the very front of the assembly 20, i.e. to that portion of the interior 50 furthest from the source of the vacuum as delivered by the fitting 46 and opening 47 located at the rear of assembly 20. This is further maximized by the fact (see FIG. 6) that the front angled support members 52 preferably have a flatter angle (relative to ribs 84) versus the angle of rear members 52, and hence, permit a larger vacuum area to occur about the front end of assembly 20 (furthest from vacuum source) through the vacuum area presented at the rear or vacuum source end of assembly 20. As seen, all vacuum air flow comes into interior 50 of upper body 22 from around the outer periphery of the sanding sheet 80, i.e. between the sanding backer plate portion 24 and the skirt member 34, whereas no vacuum air flows through the sandpaper sheet 80 or through the sandpaper pad 82. This permits the ready use of different sizes and types, i.e. grits, of sandpaper 80 to be used with apparatus 20, since no screen type sanding media is required with the present disclosure, as no debris or air flow occurs directly through the sandpaper 80 or backer plate 24.

The foregoing detailed description has been given for clearness of understanding only, and no unnecessary limitation should be understood therefrom, as modifications will be obvious to those skilled in the art.

We claim:

1. A manual sander apparatus comprising:

a sanding backer plate assembly comprising a backer plate and clamp members for detachably clamping a sheet of sandpaper in stretched placement across the backer plate;

an upper housing member having a body, a handle and a lower skirt portion, the housing member adapted to be releasably and adjustably held in place about the backer plate assembly, the housing member having a fitting member adapted to connect to a vacuum pipe member; and adjustment members mounted to at least one of the backer plate assembly and upper housing member and adapted to permit relative side-to-side adjustment of the backer plate assembly and associated sandpaper sheet relative to the upper housing member, such that an edge of the sandpaper and backer plate can extend transversely at least substantially to one of the respective edges of the lower skirt portion of the body member, thereby to permit edge-sanding.

2. The invention of claim 1, wherein the sanding backer plate assembly further comprises a sanding pad extending between the backer plate and the associated sheet of sandpaper.

3. The invention of claim 1, wherein the adjustment members comprise a slotted opening formed on the upper housing member and a fastening member supported by the sanding backer plate assembly and extending through the slotted opening.

4. The invention of claim 1, wherein the lower skirt member comprises front and rear end skirt sections, and elongated side skirt sections, with the front and rear skirt sections extending lower than the side skirt sections.

5. The invention of claim 1, wherein the upper housing member has a length dimension and a height dimension for the majority of the housing member's vacuum areas, with the height dimension being no more than within the range of from approximately 15% to 30% of the length dimension.

6. The invention of claim 1, wherein the upper housing member has a substantially horizontal platform portion formed of a central trough portion and front and rear platform sections, each platform section having an upright stanchion member between which extends the handle.

7. The invention of claim 6, wherein the handle comprises a solid member preventing any flow of vacuum air through it, to assist in maximizing vacuum air flow adjacent the periphery of backer plate assembly.

8. The invention of claim 2, wherein the adjustment members further comprise generally vertically-oriented stops carried by the backer plate assembly and air flow control ribs carried by the upper housing member.

9. The invention of claim 3, wherein the adjustment members further comprise repositioning ribs carried by the backer plate assembly and air flow control ribs carried by the upper housing member.

10. The invention of claim 1, wherein the fitting member extends rearwardly from the rear stanchion and rear skirt members.

11. The invention of claim 9, wherein the air flow control ribs are formed within the internal cavity formed by the upper housing member, the control ribs aligned generally longitudinally of the upper housing member, so as to assist the vacuum air flow movement in reaching the frontmost areas of the internal cavity.

12. The invention of claim 11, and controlled air relief areas formed on the lower edge of the air flow control ribs for assisting in enhancing vacuum air flow movement within the internal cavity and along the sides of backer plate assembly.

13. The invention of claim 1, wherein the backer plate and the upper housing member are each formed of injection-molded plastic material.

14. The invention of claim 6, wherein the cross sectioned dimension of the respective stanchion members is minimized to reduce disturbance of the vacuum air flow pattern within the interior of the upper housing member due to the presence of the stanchion members.

15. The invention of claim 11, wherein the respective outer ends of the respective air flow control ribs are angled away from one another to create enlarged vacuum air areas respectively adjacent front and rear ends of the backer plate assembly.

16. The invention of claim 15, wherein the enlarged vacuum area of the front end of the backer plate assembly is greater than the enlarged vacuum air area at the rear end of the backer plate assembly, to assist in maximizing movement of vacuum air to the front area of the housing member.

17. The invention of claim 1, wherein the clamp members comprise spring-biased clamp plates adapted to releasably clamp respective ends of a sand paper sheet to the backer plate.

18. The invention of claim 17, and pivotably movable clamp levers carried by the backer plate and adapted to temporarily lift the clamp plates against their spring bias.

19. A vacuum sander apparatus for effecting equalized air flow within the apparatus, comprising:

a housing member having a body portion, a handle, a lower skirt portion, and a fitting portion operable to be connected to a vacuum air source;

a sanding backer plate assembly including a backer plate and clamp members for detachably clamping a sandpaper sheet to the backer plate, the sanding backer plate assembly adapted to be releasably and positionally adjustably mounted to the housing to permit multiple positioning of the respective side edges of the sandpaper sheet relative to the housing; and air flow control rib members carried by the housing member extending from substantially the rear to substantially the front of the housing member to create a central vacuum air channel to assist in maximizing the vacuum air delivered to generally the front and rear portions of the housing.

20. The invention of claim 19, and including controlled air relief areas formed in the air flow control rib members to assist in stabilizing the vacuum air flow along the central vacuum air channel of the housing member and along the side edges of the housing member to maximize collection of sanded duct debris about the periphery of the housing member.

21. The invention of claim 20, and wherein the respective outer ends of the respective air flow control rib members are angled outwardly away from one another to create enveloped vacuum air areas at each respective end of the central vacuum air channel of the housing member.

22. The invention of claim 20, wherein the outward angle of the respective ends of the air control ribs is greater at the front than at the rear of the housing member.

23. A sanding apparatus for attachment to a vacuum comprising:

a housing having a top wall with a perimeter and a contiguous skirt extending downwardly from the perimeter of the top wall to define an interior having an open bottom;

a sander assembly adjustably mounted within the open bottom of the housing and having a perimeter and a pair of side edges, the sander assembly being shiftable between a first position wherein a first one of the pair of side edges extends transversely substantially near a first side edge of the contiguous skirt of the housing, and a second position wherein a second one of the pair of side edges extends transversely substantially near a second side edge of the contiguous skirt of the housing, the sander assembly having a backer plate, and at least one clamp for detachably clamping a sheet of sandpaper to overlay the sanding pad; and a vacuum fitting on an outer surface of the housing communicating with the interior of the housing, the vacuum fitting being in fluid communication with the interior of the housing.

24. The invention of claim 23, wherein the sander assembly includes a sanding pad positioned adjacent the backer plate, and at least one clamp for detachably clamping a sheet of sandpaper to overlay the sanding pad.

25. The apparatus of claim 23, further comprising an air flow path defined between the perimeter of the sander assembly and the contiguous skirt of the housing, and wherein the vacuum fitting is in flow communication with the air fluid path.

26. The apparatus of claim 23, wherein the housing further comprises a handle, wherein the handle is adapted to prevent air flow through the handle.

27. The apparatus of claim 23, wherein the housing further comprises a slotted opening formed on the housing and adapted to support a fastener attached to the sander assembly and extending through the slotted opening.

28. The apparatus of claim 23, wherein the contiguous skirt further comprises a front and rear skirt sections, and a pair of elongated side skirt sections, wherein the front and rear skirt sections extend lower than the pair of elongated side skirt sections.

29. The apparatus of claim 23, wherein the housing has a length dimension and the contiguous skirt extends downward from the housing through a height dimension, and wherein the height dimension of the contiguous skirt is within the range of from approximately fifteen percent to thirty percent of the length dimension of the housing.

30. The apparatus of claim 23, wherein the housing further comprises a substantially horizontal platform formed of a front platform section and a rear platform section connected by a central trough.

31. The apparatus of claim 30, wherein the horizontal platform further comprises a first upright stanchion extending upwardly from the front platform section, and a second upright stanchion extending upwardly from the rear platform section.

32. The apparatus of claim 31, wherein the housing further comprises a handle extending between the first and second upright stanchions, wherein the handle is adapted to prevent air flow therethrough.

33. The apparatus of claim 30, wherein the horizontal platform further comprises a pair of air flow control ribs extending downwardly from the horizontal platform and spaced away from the perimeter of the housing.

34. The apparatus of claim 33, wherein the air flow control ribs are aligned generally longitudinally along the housing and extend generally between the front platform section and the rear platform section and adapted to aid air movement between the front platform section and the rear platform section toward the vacuum fitting.

35. The apparatus of claim 34, wherein each of the air flow control ribs further comprise an air relief formed within a lower edge of each of the air flow control ribs and adapted to allow air movement through the air relief and along the perimeter of the sander assembly.

36. The apparatus of claim 35, wherein the respective outer ends of the respective air flow control ribs are angled away from each other to create an enlarged vacuum air area respectively adjacent front and rear ends of the sander assembly.

37. The apparatus of claim 35, and respective pluralities of repositioning ribs carried by the backer plate, wherein engagement of lower edges of the air flow control ribs with the repositioning ribs permit respective selected centered, right edge, and left-edge sanding.

* * * * *